US005924488A

United States Patent [19]

Nguyen et al.

[11] Patent Number: 5,924,488

[45] Date of Patent: Jul. 20, 1999

[54] METHODS OF PREVENTING WELL FRACTURE PROPPANT FLOW-BACK

[75] Inventors: Philip D. Nguyen, Duncan; David L. Brown, Temple; Steven F. Wilson, Duncan, all of Okla.

[73] Assignee: Halliburton Energy Services, Inc., Duncan, Okla.

[21] Appl. No.: 08/872,912

[22] Filed: Jun. 11, 1997

[51] Int. Cl.[6] ..... E21B 43/02

[52] U.S. Cl. ..... 166/280; 166/281

[58] Field of Search ..... 106/280, 281, 106/308, 276

[56] References Cited

U.S. PATENT DOCUMENTS

| | | | |
|---|---|---|---|
| 3,929,191 | 12/1975 | Graham et al. | 166/276 |
| 4,042,032 | 8/1977 | Anderson et al. | 166/276 |
| 4,070,865 | 1/1978 | McLaughlin | 61/36 C |
| 4,585,064 | 4/1986 | Graham et al. | 166/280 |
| 4,694,905 | 9/1987 | Armbruster | 166/280 |
| 4,785,884 | 11/1988 | Armbruster | 166/280 |
| 4,875,525 | 10/1989 | Mana | 166/281 |
| 4,898,750 | 2/1990 | Friedman et al. | 166/280 |
| 5,058,676 | 10/1991 | Fitzpatrick et al. | 166/278 |
| 5,128,390 | 7/1992 | Murphey et al. | 523/130 |
| 5,381,864 | 1/1995 | Nguyen et al. | 166/280 |
| 5,492,178 | 2/1996 | Nguyen et al. | 166/276 |
| 5,609,207 | 3/1997 | Dewprashad et al. | 166/281 |
| 5,620,049 | 4/1997 | Gipson et al. | 166/281 |
| 5,775,425 | 7/1998 | Weaver et al. | 166/281 |

OTHER PUBLICATIONS

SPE Paper No. 20840 entitled "*Application of Curable Resin–Coated Proppants*" by L.R. Norman, J.M. Terracina, MA. McCabe and P.D. Nguyen, presented at the SPE Annual Technical Conference and Exhibition held in New Orleans, Louisiana, Sep. 23–26, 1990.

*Primary Examiner*—William Neuder
*Attorney, Agent, or Firm*—Robert A. Kent; C. Clark Dougherty, Jr.

[57] ABSTRACT

The present invention provides improved methods of placing proppant in fractures formed in a subterranean zone to prevent the subsequent flow-back of the proppant with fluids produced from the zone. The methods are basically comprised of the steps of depositing a mixture of hardenable resin composition coated proppant and uncoated proppant in the fractures and then causing the resin composition to harden into stationary permeable masses in the fractures.

18 Claims, No Drawings

METHODS OF PREVENTING WELL FRACTURE PROPPANT FLOW-BACK

BACKGROUND OF THE INVENTION

1. Field of the Invention

The present invention relates generally to improved methods of preventing well fracture proppant flow-back, and more particularly, to improved methods of fracturing a subterranean zone and propping the fractures whereby proppant flow-back from the fractures is prevented.

2. Description of the Prior Art

Oil and gas wells are often stimulated by hydraulically fracturing subterranean producing zones penetrated thereby. In such hydraulic fracturing treatments, a viscous fracturing fluid is pumped into the zone to be fractured at a rate and pressure such that one or more fractures are formed and extended in the zone. A solid particulate material for propping the fractures open, referred to herein as "proppant," is suspended in a portion of the fracturing fluid so that the proppant is deposited in the fractures when the viscous fracturing fluid is caused to revert to a thin fluid and return to the surface. The proppant functions to prevent the fractures from closing whereby conductive channels are formed through which produced fluids can readily flow.

In order to prevent the subsequent flow-back of the proppant with fluids produced from the fractured zone, at least a portion of the proppant has heretofore been coated with a hardenable resin composition and consolidated into a hard permeable mass. Typically, the resin composition coated proppant is deposited in the fractures after a larger quantity of uncoated proppant material has been deposited therein. That is, the last portion of the proppant deposited in each fracture, referred to in the art as the "tail-in" portion, is coated with a hardenable resin composition. Upon the hardening of the resin composition, the tail-in portion of the proppant is consolidated into a hard permeable mass having a compressive strength in the range of from at least about 50 psi to 200 psi or more.

While the consolidated tail-in portion of proppant can be effective in preventing proppant flow-back with produced fluids if it is placed in the fractures near the well bore, very often the resin composition coated tail-in portion of the proppant is carried over uncoated proppant which previously settled near the well bore. This causes the resin coated proppant to be deposited deeply inside the fractures whereby it is incapable of preventing the flow-back of uncoated proppant between it and the well bore. Thus, there is a need for improved methods of placing proppant in subterranean zones whereby the flow-back of proppant with produced fluids is effectively prevented.

SUMMARY OF THE INVENTION

The present invention provides improved methods of fracturing a subterranean zone and placing proppant therein which meet the needs described above and overcome the deficiencies of the prior art. The methods are basically comprised of the steps of depositing a mixture of hardenable resin composition coated proppant and uncoated proppant in one or more fractures formed in a subterranean zone which upon hardening of the resin composition has an overall compressive strength in the range of from about 25 psi to about 175 psi depending on the type of resin coated proppant used and the expected flow rate of fluids produced from the zone through the propped fractures. Thereafter the resin composition is caused to harden whereby the proppant is consolidated into a stationary permeable mass.

The mixture of resin coated and uncoated proppant utilized in accordance with the present invention often includes less resin coated proppant and is less costly than is the case when the resin coated portion of the proppant is tailed-in. More importantly, the proppant mixture of the present invention includes some consolidated proppant throughout the entire proppant pack including the portion of the proppant adjacent to the well bore whereby proppant flow-back is effectively prevented.

It is, therefore, a general object of the present invention to provide improved methods of preventing well fracture proppant flow-back.

Other and further objects, features and advantages of the present invention will be readily apparent to those skilled in the art upon a reading of the description of preferred embodiments which follows.

DESCRIPTION OF THE PREFERRED EMBODIMENTS

The present invention provides improved methods of fracturing a subterranean zone penetrated by a well bore and placing proppant therein whereby the subsequent flow-back of the proppant with produced fluids from the zone is prevented.

The creation of fractures in a subterranean zone utilizing hydraulic fracturing is well known to those skilled in the art. The hydraulic fracturing process generally involves pumping a viscous fracturing fluid, a portion of which contains suspended proppant, into the subterranean zone by way of the well bore penetrating it at a rate and pressure whereby fractures are created in the zone. The continued pumping of the fracturing fluid extends the fractures in the formation and carries proppant into the fractures. Upon the reduction of the flow of fracturing fluid and pressure exerted on the formation along with the breaking of the viscous fluid into a thin fluid, the proppant is deposited in the fractures and the fractures are prevented from closing by the presence of the proppant therein.

As mentioned above, in order to prevent the subsequent flow-back of proppant with fluids produced from the fractured zone, hardenable resin composition coated proppant has heretofore been deposited in the formed fractures. Typically, to save cost the resin composition coated proppant is the tail-in portion of proppant deposited in the fractures after a larger portion of uncoated proppant has been deposited therein. In order to prevent the flow-back of proppant from the fractured zone with produced fluids, it has heretofore been the belief of those skilled in the art that the resin coated tail-in portion of the proppant is deposited adjacent to the well bore and holds the more deeply deposited uncoated proppant in the fractures. As mentioned above, the resin coated tail-in portion of the proppant is very often conveyed by the fracturing fluid over previously settled uncoated proppant near the well bore whereby the resin coated proppant ends up being deposited more deeply in the fractures. As a result, the subsequently consolidated resin coated proppant is ineffective in preventing proppant flow-back.

The improved methods of the present invention are often less costly than the heretofore used methods as a result of less resin coated proppant being utilized. Further, the mixture of hardenable resin composition coated proppant and uncoated proppant used in accordance with this invention can have a relatively low compressive strength, i.e., a compressive strength in the range of from about 25 psi to about 175 psi, and still effectively prevent proppant flow-back due to the consolidation of resin coated proppant adjacent to the well bore and throughout the proppant packs deposited in the created fractures.

The methods of the present invention of placing proppant in a fracture in a subterranean zone and preventing the subsequent flow-back of the proppant with produced fluids basically comprise the steps of depositing a mixture of hardenable resin composition coated proppant and uncoated proppant in the fracture, the mixture having an overall compressive strength after the resin composition hardens in the range of from about 25 psi to about 175 psi, and then causing the resin composition to harden whereby the proppant is consolidated into a stationary permeable mass. The amount of resin composition coated proppant contained in the proppant mixture is generally in the range of from about 20% to about 75% by weight of the mixture.

The improved methods of the present invention of fracturing a subterranean zone penetrated by a well bore and placing proppant therein whereby flow-back of proppant with produced fluids from the subterranean zone is prevented comprise the steps of suspending a mixture of hardenable resin composition coated proppant and uncoated proppant in a portion of a fracturing fluid, the mixture containing resin composition coated proppant in an amount in the range of from about 20% to about 75% by weight of the proppant mixture and having an overall compressive strength after the resin composition hardens in the range of from about 25 psi to about 175 psi; pumping the fracturing fluid by way of the well bore into the subterranean zone at a sufficient rate and pressure to fracture the zone and to deposit the mixture of hardenable resin composition coated proppant and uncoated proppant in the fracture or fractures formed; and then causing the resin composition to harden whereby the proppant in the fracture or fractures is consolidated into one or more stationary permeable masses.

Typical fracturing fluids which have been utilized heretofore include gelled water or oil based liquids, foam and emulsions. The foams utilized have generally been comprised of water based liquids containing one or more foaming agents and foamed with a gas such as nitrogen or air. Emulsions formed with two or more immiscible liquids have also been utilized. A particularly useful emulsion for carrying out formation fracturing procedures is comprised of a water based liquid and a liquified, normally gaseous fluid such as carbon dioxide. Upon pressure release, the liquified gaseous fluid vaporizes and rapidly flows out of the formation.

The most common fracturing fluid utilized heretofore has been comprised of an aqueous liquid such as fresh water or salt water combined with a gelling agent which can be crosslinked for increasing the viscosity of the fluid. The increased viscosity reduces fluid loss and allows the fracturing fluid to transport significant quantities of proppant into the created fractures.

A variety of gelling agents have been utilized including hydratible polymers which contain one or more of the functional groups such as hydroxyl, cis-hydroxyl, carboxyl, sulfate, sulfonate, amino or amide. Particularly useful such polymers are polysaccharides and derivatives thereof which contain one or more of the monosaccharide units galactose, mannose, glucoside, glucose, xylose, arabinose, fructose, glucuronic acid or pyranosyl sulfate. Natural hydratable polymers containing the foregoing functional groups and units include guar gum and derivatives thereof, locust bean gum, tara, konjak, tamarind, starch, cellulose and derivatives thereof, karaya, xanthan, tragacanth and carrageenan. Hydratible synthetic polymers and copolymers which contain the above mentioned functional groups and which have been utilized heretofore include polyacrylate, polymethacrylate, polyacrylamide, maleic anhydride, methylvinyl ether polymers, polyvinyl alcohol and polyvinylpyrrolidone.

Preferred hydratible polymers which yield high viscosities upon hydration, i.e., apparent viscosities in the range of from about 10 centipoises to about 90 centipoises at concentrations in the range of from about 10 pounds per 1,000 gallons to about 80 pounds per 1,000 gallons in water, are guar gum and guar derivatives such as hydroxypropylguar and carboxymethylguar, cellulose derivatives such as hydroxyethyl cellulose, carboxymethyl cellulose and carboxymethylhydroxy-ethyl cellulose, locust bean gum, carrageenan gum and xanthan gum.

The viscosities of aqueous polymer solutions of the types described above can be increased by combining crosslinking agents with the polymer solutions. Examples of crosslinking agents which can be utilized are multivalent metal salts or other compounds which are capable of releasing multivalent metal ions in an aqueous solution. Examples of such multivalent metal ions are chromium, zirconium, antimony, titanium, iron (ferrous or ferric), zinc or aluminum. The above described gelled or gelled and crosslinked fracturing fluids can also include gel breakers such as those of the enzyme type, the oxidizing type or the acid buffer type which are well known to those skilled in the art. The gel breakers cause the viscous fracturing fluid to revert to thin fluids that can be produced back to the surface after they have been used to create fractures and carry proppant in a subterranean zone.

As mentioned above, the mixture of proppant utilized in accordance with this invention is suspended in the viscous fracturing fluid so that it is carried into the formed fractures in a subterranean zone and deposited therein by the fracturing fluid when the flow rate of the fracturing fluid and the pressure exerted on the fractured subterranean zone are reduced. The proppant functions to prevent the fractures from closing due to overburden pressures, i.e., to maintain the fractures in an open position whereby produced fluids can flow through the fractures. The proppant is of a size such that formation sands migrating with produced fluids are prevented from flowing through the flow channels formed by the fractures. Various kinds of particulate materials can be utilized as proppant in accordance with this invention including sand, bauxite, ceramic materials, glass materials, "TEFLON™" materials and the like. Generally, the particulate material used has a particle size in the range of from about 2 to about 400 mesh, U.S. Sieve Series. The preferred particulate material is sand having a particle size in the range of from about 10 to about 70 mesh, U.S. Sieve Series. Preferred sand particle size distribution ranges are one or more of 10-20 mesh, 20-40 mesh, 40-60 mesh or 50-70 mesh, depending on the particle size and distribution of the formation sand to be screened out by the proppant.

The hardenable resin compositions which are useful in accordance with the present invention are well known to those skilled in the art and are generally comprised of a hardenable organic resin and a resin-to-sand coupling agent. A number of such compositions are described in detail in U.S. Pat. No. 4,042,032 issued to Anderson et al. on Aug. 16, 1977, U.S. Pat. No. 4,070,865 issued to McLaughlin on Jan. 31, 1978, U.S. Pat. No. 5,058,676 issued to Fitzpatrick et al. on Oct. 22, 1991 and U.S. Pat. No. 5,128,390 issued to Murphey et al. on Jul. 7, 1992, all of which are incorporated herein by reference. The hardenable organic resin used is preferably a liquid at 80° F. and is cured or hardened by heating or by contact with a hardening agent.

Examples of hardenable organic resins which are particularly suitable for use in accordance with this invention are novolak resins, polyepoxide resins, polyester resins, phenol-aldehyde resins, urea-aldehyde resins, furan resins and urethane resins. Of these, polyepoxide resins are preferred. The resins are available at various viscosities, depending upon the molecular weight of the resin. The preferred viscosity of the organic resin used in accordance with this invention is in the range of from about 1 to about 1,000 centipoises at 80° F. However, as will be understood, resins of higher viscosities can be utilized when mixed or blended with one or more diluents. Examples of suitable diluents for polyepoxide resins are styrene oxide, octylene oxide, furfuryl alcohol, phenols, furfural, liquid monoepoxides such as allyl glycidyl ether, and liquid diepoxides such as diglycidyl ether or resorcinol. Examples of such diluents for furfuryl alcohol resins, phenol-aldehyde resins and urea-aldehyde resins include, but are not limited to, furfuryl alcohol, furfural, phenol and cresol. Diluents which are generally useful with all of the various resins mentioned above include phenols, formaldehydes, furfuryl alcohol and furfural.

The resin-to-sand coupling agent is utilized in the hardenable resin compositions to promote coupling or adhesion to sand and other silicious materials in the formation to be treated. A particularly suitable such coupling agent is an aminosilane compound or a mixture of such compounds selected from the group consisting of N-β-(aminoethyl)-γ-aminopropyl-trimethoxysilane, N-β-(aminoethyl)-N-β-(aminoethyl)-γ-aminopropyltrimethoxysilane, N-β-(aminopropyl)-N-β-(aminobutyl)-γ-aminopropyltriethoxysilane and N-β-(amino-propyl)-γ-aminopropyltriethoxysilane. The most preferred coupling agent is N-β-(aminoethyl)-γ-aminopropyltrimethoxy-silane.

As mentioned, the hardenable resin composition used is caused to harden by heating in the formation or by contact with a hardening agent. When a hardening agent is utilized, it can be included in the resin composition (internal hardening agents) or the resin composition can be contacted with the hardening agent after the resin composition has been placed in the subterranean formation to be consolidated (external hardening agents). When an internal hardening agent is used it is selected whereby it causes the resin composition to harden after a period of time sufficient for the resin composition to be placed in a subterranean zone. Retarders or accelerators to lengthen or shorten the cure times are also utilized. When an external hardening agent is used, the hardenable resin composition is first placed in a zone or formation to be consolidated followed by an overflush solution containing the external hardening agent.

Suitable internal hardening agents for hardening resin compositions containing polyepoxide resins include, but are not limited to, amines, polyamines, amides and polyamides. A more preferred internal hardening agent for polyepoxide resins is a liquid eutectic mixture of amines and methylene dianiline diluted with methyl alcohol. Examples of internal hardening agents which can be used with resin compositions containing furan resins, phenol-aldehyde resins, urea-aldehyde resins and the like are hexachloroacetone, 1,1,3-trichlorotrifluoro-acetone, benzotrichloride, benzylchloride and benzalchloride.

Examples of external hardening agents for consolidating furan resins, phenol-aldehyde resins and urea-aldehyde resins are acylhalide compounds, benzotrichloride, acetic acid, formic acid and inorganic acids such as hydrochloric acid. Generally, external hardening agents selected from the group consisting of inorganic acids, organic acids and acid producing chemicals are preferred. The hardenable resin compositions can also include surfactants, dispersants and other additives well known to those skilled in the art.

As previously described, the proppant mixture utilized in accordance with the present invention contains hardenable resin composition coated proppant in an amount in the range of from about 20% to about 75% by weight of the proppant mixture. Various techniques can be utilized for producing the mixture and suspending it in the viscous fracturing fluid utilized. For example, a portion of the proppant can be precoated with hardenable resin composition using conventional batch mixing techniques followed by suspending it and the uncoated proppant in the fracture fluid in an intermittent manner so that the proppant mixture suspended in the fracturing fluid is made up of successively alternating portions of resin coated and uncoated proppant. In an alternate technique, the entire quantity of proppant used can be suspended in the fracturing fluid with the hardenable resin composition being injected into the fluid and onto portions of the proppant as the fracturing fluid containing the proppant is pumped, i.e., the resin composition can be injected on-the-fly intermittently in accordance with the methods described in U.S. Pat. No. 4,829,100 issued on May 9, 1989 to Murphey et al. or U.S. Pat. No. 5,128,390 issued on Jul. 7, 1992 to Murphey et al., both of which are incorporated herein by reference.

In order to further illustrate the methods of the present invention the following example is given.

EXAMPLE

To determine the compressive strengths of various proppant mixture samples, slurries having varying ratios of 20/40 mesh, pre-cured, resin-coated Ottawa sand (ACFRAC® CR from Borden Inc. of Oregon, Ill.) and 20/40 mesh uncoated Ottawa sand were prepared in a 30 lb/1000 gal. aqueous guar gelled fracturing fluid. The mixed slurries were then packed in glass tubes and cured at 175° F. for 20 hours under a compressive load of 4 $lb_f$-inch. Table 1 shows the ranges of compressive strengths obtained for these mixed samples.

Each of the mixed slurries were also packed in an unconfined flow cell and cured at 175° F. for 20 hours under a stress load of 1,000 psi (to simulate the closure stress applied to proppant in a fracture). After curing, the flow cell was connected to a water pumping system to determine the flow rate at which proppant began to produce out of the cell with the pumped water. The outlet end of the flow cell included a ½ inch perforation to simulate the usual perforation size in a well. The Table also shows the flow rates at which proppant was produced for each proppant mixture sample tested.

TABLE

| Proppant Mixture Sample, %'s of Resin Coated and Uncoated Ottawa Sand | Compressive Strength (psi) | Flow Rate When Proppant Began To Produce (BPD/Perf)* |
|---|---|---|
| 100%/0% | 650–900 | >300 |
| 75%/25% | 135–170 | 230 |
| 50%/50% | 50–70 | 170 |
| 30%/70% | 25–40 | 100 |
| 20%/80% | <10 | 20 |

*BPD/Perf = Barrels per day per perforation

Thus, the present invention is well adapted to carry out the objects and attain the ends and advantages mentioned as well as those inherent therein. While numerous changes may be made by those skilled in the art, such changes are encompassed within the spirit of this invention as defined by the appended claims.

What is claimed is:

1. An improved method of placing proppant in a fracture in a subterranean zone to prevent the subsequent flow-back of the proppant with produced fluids comprising the steps of:

depositing a mixture of hardenable resin composition coated proppant and uncoated proppant in said fracture, said resin composition coated proppant being present in said mixture in an amount in the range of from about 20% to about 69% and said mixture having an overall compressive strength after said resin composition hardens in the range of from about 25 psi. to about 175 psi.; and causing said resin composition to harden whereby said proppant is consolidated into a stationary permeable mass.

2. The method of claim 1 wherein said proppant is sand.

3. The method of claim 1 wherein said hardenable resin composition is comprised of a hardenable organic resin and a coupling agent.

4. The method of claim 3 wherein said hardenable organic resin is selected from the group of novolak resins, polyepoxide resins, polyester resins, phenol-aldehyde resins, urea-aldehyde resins, furan resins and urethane resins.

5. The method of claim 4 wherein said coupling agent comprises an aminosilane compound.

6. The method of claim 5 wherein said hardenable resin composition is caused to harden by being heated in said formation.

7. The method of claim 5 wherein said hardenable resin composition is caused to harden by including an internal hardening agent in said composition.

8. The method of claim 5 wherein said hardenable resin composition is caused to harden by contacting said composition with an external hardening agent.

9. An improved method of fracturing a subterranean zone penetrated by a well bore and placing proppant therein whereby flow-back of proppant with produced fluids from the subterranean zone is prevented comprising the steps of:

pumping a fracturing fluid by way of said well bore into said subterranean zone at a sufficient rate and pressure to fracture said zone;

depositing a mixture of hardenable resin composition coated proppant and uncoated proppant in the fracture or fractures formed in said zone, said resin composition coated proppant being present in said mixture in an amount in the range of from about 20% to about 69% and said mixture having an overall compressive strength after said resin composition hardens in the range of from about 25 psi to about 175 psi; and causing said resin composition to harden whereby said proppant in said fracture or fractures is consolidated into one or more stationary permeable masses.

10. The method of claim 9 wherein said proppant is sand.

11. The method of claim 9 wherein said hardenable resin composition is comprised of a hardenable organic resin and a coupling agent.

12. The method of claim 9 wherein said mixture of hardenable resin composition coated proppant and uncoated proppant is suspended in said fracturing fluid and is deposited in said fracture or fractures by said fracturing fluid.

13. The method of claim 11 wherein said hardenable organic resin is selected from the group of novolak resins, polyepoxide resins, polyester resins, phenol-aldehyde resins, urea-aldehyde resins, furan resins and urethane resins.

14. The method of claim 13 wherein said coupling agent comprises an aminosilane compound.

15. An improved method of fracturing a subterranean zone penetrated by a well bore and placing proppant therein whereby flow-back of proppant with produced fluids from the subterranean zone is prevented comprising the steps of:

suspending a mixture of hardenable resin composition coated proppant and uncoated proppant in a fracturing fluid, said mixture containing resin composition coated proppant in an amount in the range of from about 20% to about 69% by weight of said proppant mixture and having an overall compressive strength after said resin composition hardens in the range of from about 75 psi to about 175 psi;

pumping said fracturing fluid by way of said well bore into said subterranean zone at a sufficient rate and pressure to fracture said zone and to deposit said mixture of hardenable resin composition coated proppant and uncoated proppant in the fracture or fractures formed; and causing said resin composition to harden whereby said proppant in said fracture or fractures is consolidated into one or more stationary permeable masses.

16. The method of claim 15 wherein said proppant is sand.

17. The method of claim 16 wherein said hardenable resin composition is comprised of a hardenable organic resin and a coupling agent.

18. The method of claim 16 wherein said hardenable resin composition is comprised of a polyepoxide resin, an aminosilane coupling agent and an internal hardening agent comprised of a liquid eutectic mixture of amines and methylene dianiline diluted with methyl alcohol.

* * * * *